US006731892B2

(12) United States Patent
Doi

(10) Patent No.: US 6,731,892 B2
(45) Date of Patent: May 4, 2004

(54) IMAGE FORMING APPARATUS HAVING HIGH-VOLTAGE POWER SUPPLY

(75) Inventor: Koji Doi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/268,936

(22) Filed: Oct. 11, 2002

(65) Prior Publication Data

US 2003/0072583 A1 Apr. 17, 2003

(30) Foreign Application Priority Data

Oct. 16, 2001 (JP) ..... 2001-318237

(51) Int. Cl.[7] ..... G03G 15/20
(52) U.S. Cl. ..... 399/88; 399/310
(58) Field of Search ..... 399/88, 66, 50, 399/297; 307/51, 80, 85

(56) References Cited

U.S. PATENT DOCUMENTS 4,868,729 A * 9/1989 Suzuki ..... 399/88
5,568,226 A * 10/1996 Kusano ..... 399/88
6,070,025 A * 5/2000 Jeong ..... 399/66
6,442,356 B2 * 8/2002 Omata et al. ..... 399/66

FOREIGN PATENT DOCUMENTS

JP 2000284617 A * 10/2000 ..... G03G/15/16

* cited by examiner

*Primary Examiner*—Arthur T. Grimley
*Assistant Examiner*—Ryan Gleitz
(74) *Attorney, Agent, or Firm*—Fitzpatrick, Cella, Harper & Scinto

(57) ABSTRACT

An image forming apparatus that prevents adverse effects caused by a transferring device on image formation while no high voltages are being applied to a transferring device includes a transferring device that transfers a developed image resting on an image carrier, to a medium, a high-voltage power supply that applies a high voltage to the transferring device, and a disabling device that disables a flow of current through the transferring device while the high-voltage power supply is not applying any high voltage to the transferring device.

16 Claims, 5 Drawing Sheets

IMAGE FORMING APPARATUS HAVING HIGH-VOLTAGE POWER SUPPLY

BACKGROUND OF THE INVENTION

1. Field of the Invention

The present invention relates to an image forming apparatus having a high-voltage power supply.

2. Related Background Art

In FIG. 4, reference numerals 1*a* to 1*d* denote photosensitive drums on which toner images are formed on the basis of an electrophotographic process. Reference numeral 2 denotes a transferring belt to which the toner images formed on the photosensitive drums are transferred in the order of 1*a* to 1*d*. Reference numerals 3*a* to 3*d* denote transferring blades to which predetermined high-voltage outputs are provided using predetermined timings in order to transfer the toner images to the transferring belt 2. Reference numerals 4*a* to 4*d* denote transferring high-voltage power supplies that respectively supply predetermined high-voltage outputs to the transferring blades 3*a*–3*d*. Reference numeral 5 denotes a cleaner blade that scrapes stains such as toner remaining on the transferring belt 2. Reference numeral 6 denotes a brush provided inside the transferring belt 2 in order to eliminate static electricity from the transferring belt 2 charged by the above described application of the transferring high voltage. Reference numeral 7 denotes a high-voltage power supply that supplies a predetermined static-electricity eliminating high voltage to the brush 6.

In the illustrated configuration, a transferring sheet 8 is supplied from the right of the drawing. The transferring sheet 8 attracted to the transferring belt 2 moves synchronously with rotation of the transferring belt 2 and reaches the photosensitive drum 1*a*. At this time, a toner image has already been formed on the photosensitive drum 1*a* and is transferred to the transferring sheet 8 by the transferring blade 3*a* and a predetermined high-voltage output to the blade 3*a* supplied from the transferring high-voltage power supply 4*a*. Subsequently, the transferring sheet 8 is conveyed to the photosensitive drums 1*b*, 1*c*, and 1*d*, where the respective toner images are transferred to the transferring sheet at the respective positions so as to be superimposed on one another. The transferring sheet then passes through a fixer (not shown) provided at the left end of the transferring belt 2, where the toner images superimposed on one another on the transferring sheet are fixed to the transferring sheet 8. On the other hand, the transferring belt 2 continues to rotate after the transferring sheet 8 has been discharged. The cleaner blade 5 scrapes residual toner off. Furthermore, a high-voltage output by the high-voltage power supply 7 supplied to the transferring brush 6 eliminates the charges by the transferring high-voltage output. The transferring belt 2 is weakly negatively charged in order to allow the supplied transferring sheet to be stuck thereto.

FIG. 5 shows an operation of a transferring process on the transferring blade 3*a*. In the drawing, reference character t denotes the elapse of time counted with reference to the transferring blade 3*a*. Reference character ta denotes the point of time when the transferring sheet 8 passes through the transferring blade 3. Reference character tb denotes the point of time when the leading end of an image transferred to the transferring sheet 8 reaches the transferring blade. Further, the drawing shows on its axis of ordinates a variation in the voltage of the transferring high-voltage output supplied to the transferring blades. The voltage measured before the transferring sheet 8 reaches the transferring blade 3*a* is defined as V0. The transferring high-voltage power supply 4*a* is controlled so that the voltage starts to increase immediately after the transferring sheet 8 has passed through the transferring blade 3*a* and so that a desired transferring voltage is reached before a toner image on the photosensitive drum 1*a* reaches the transferring blade 3*a*.

The above operation of transferring a toner image is similarly repeated for the photosensitive drums 1*b*, 1*c*, and 1*d* to superimpose toner images of four colors including cyan, magenta, yellow, and black on one another on the transferring sheet 8. Thus, a full color image is formed on the transferring sheet 8.

The voltage V0 in the drawing is weakly negative by the output from the above described high-voltage power supply 7. Accordingly, when the transferring sheet 8 is absent, even if the transferring high-voltage output supplied to the transferring blade 3 is set at 0 V, a current flows from the transferring blades 3*a* to 3*d* toward the transferring belt 2. This current serves to charge the photosensitive drum 1 via the transferring belt 2 and form an electrostatic latent image on the photosensitive drum 1. When toner sticks to the electrostatic latent image, it is transferred to a conveyed transferring sheet 8 and a band-like stain image appears on a transferred image to be primarily formed.

To prevent such a stain image, the transferring high-voltage power supplies 4*a* to 4*d* are so structured to allow the output of polarity reverse to the inherent transferring high-voltage output, so that the current from the transferring blades 3*a* to 3*d* is controlled to 0 $\mu$A at the place where the transferring sheets 8 is absent.

The previously described conventional high-voltage power supply apparatus has the following problems:

As described above, the outputs from the transferring high-voltage power supplies 4*a* to 4*d* at the place where the transferring sheets 8 is absent must be controlled to 0 $\mu$A. However, a control circuit for the transferring high-voltage power supplies itself has a margin of error, so that the current outputs must have a certain tolerance. However, as previously described, the current flowing from the transferring blades 3*a* to 3*d* toward the transferring belt 2 (positive direction) causes stain images and is thus intolerable. Thus, a method has been put to practical use which sets the outputs from the transferring high-voltage power supplies 4*a* to 4*d* to be weakly negative where the transferring sheet 8 is absent, so as to allow a very small current to flow from the transferring belt 2 toward the transferring blades 3*a* to 3*d* (negative direction). However, with this method, a current of minus several $\mu$A, which may include a margin of error, may flow. Accordingly, in order to minimize this current, the magnitude of the error must be reduced, thereby making the configuration of the transferring high-voltage power supplies 4*a* to 4*d* difficult. On the other hand, an attempt to tolerate a large current in the negative direction causes the photosensitive drum 1 to be charged with a current flowing in the direction opposite to the one previously described. Then, inversely biased toner may be developed, also staining the transferred image.

SUMMARY OF THE INVENTION

It is an object of the present invention to provide an image forming apparatus that solves the above described problems.

It is another object of the present invention to provide an image forming apparatus that prevents the adverse effects of a transferring device on image formation while no high voltages are being applied to the transferring device.

It is yet another object of the present invention to provide an image forming apparatus having a transferring device that transfers a developed image resting on an image carrier to a medium, a high-voltage power supply that applies a high voltage to the transferring device, and a disabling device that disables the flow of a current through the transferring device when the above described high-voltage power supply doesn't apply any high voltage to the above described transferring device.

It is still another object of the present invention to provide an image forming apparatus having a first high-voltage power supply that applies a high voltage to a load, a second high-voltage power supply that applies a high voltage having an opposite polarity compared to the first high-voltage power supply, and a current disabling device that disables the flow of a current from the second high-voltage power supply.

Other objects and features will be apparent from the following specification and drawings.

DETAILED DESCRIPTION OF THE PREFERRED EMBODIMENTS (Embodiment 1)

An electrophotographic apparatus as Embodiment 1 will be described with reference to FIGS. 6 and 7.

Figure 6:
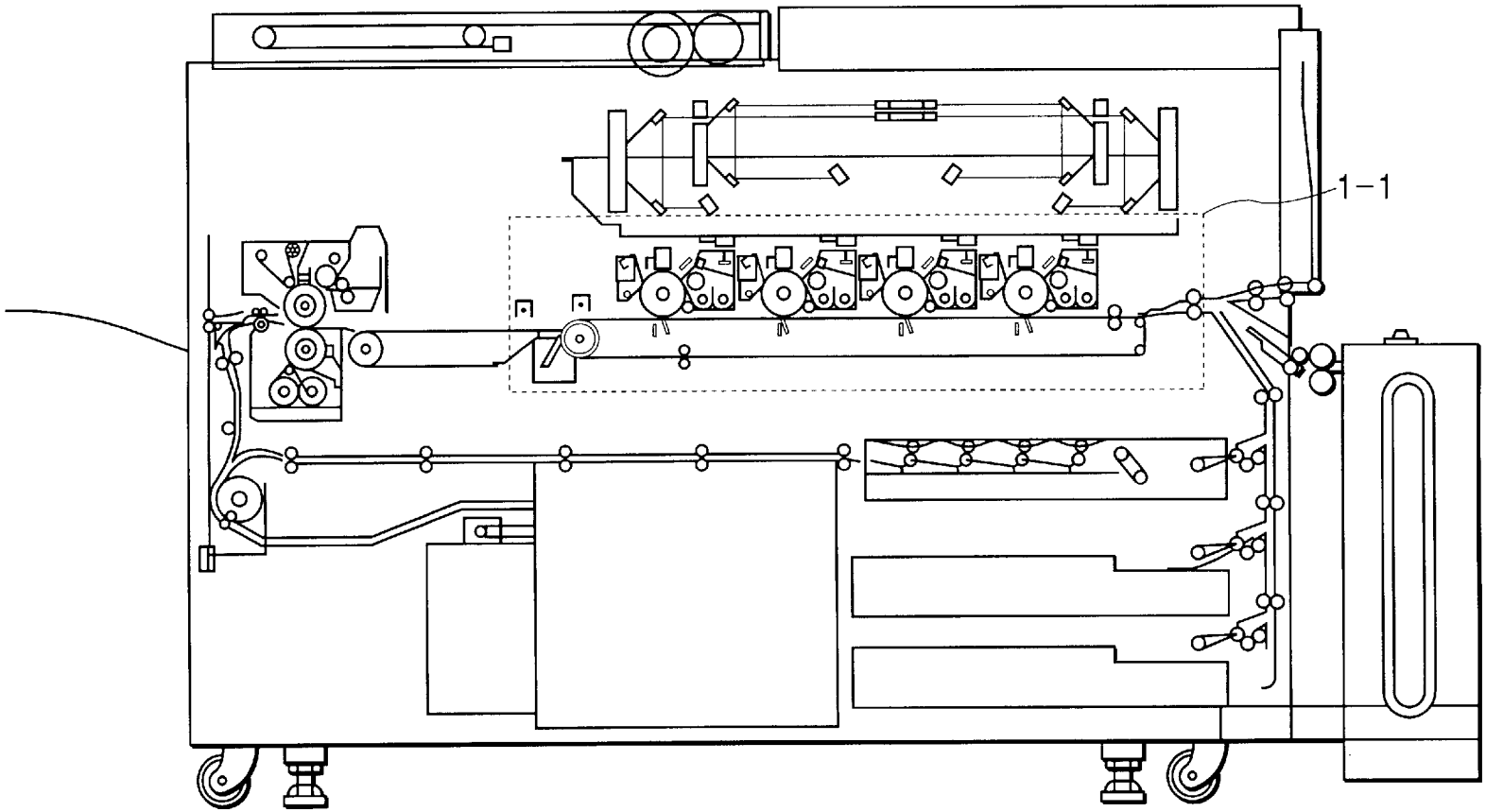
FIG. 6 is a sectional view of the electrophotographic apparatus.
Figure 7:
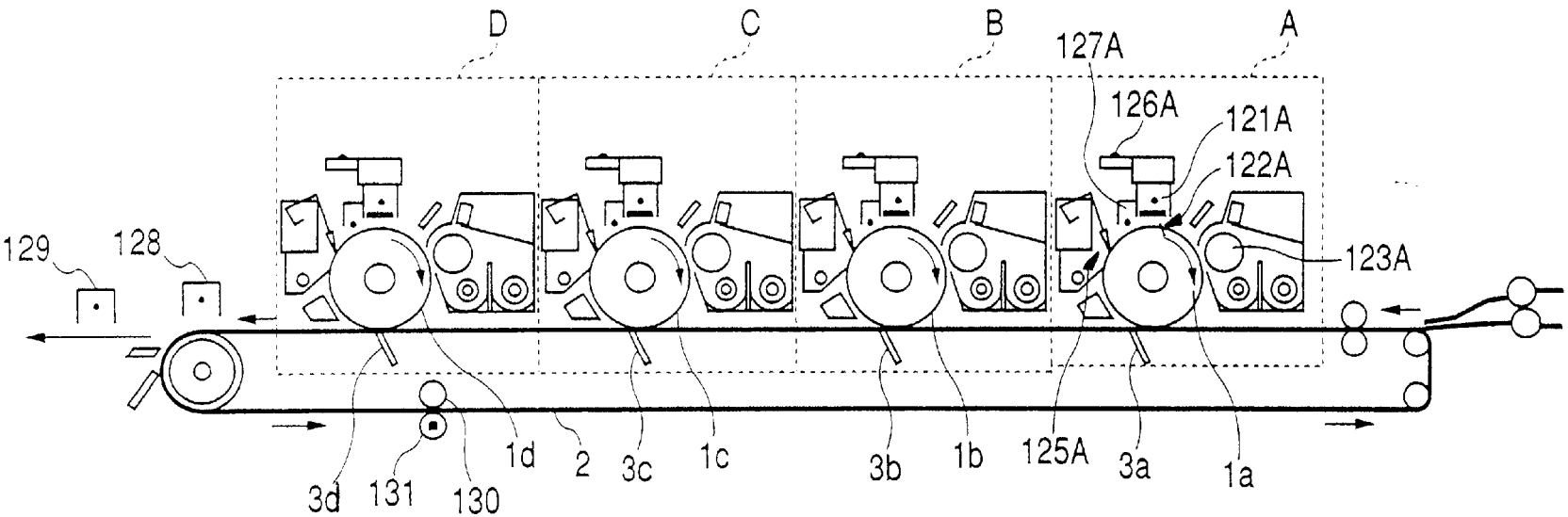
FIG. 7 is a diagram illustrating an image forming process executed by the electrophotographic apparatus.

FIG. 6 is a sectional view of the electrophotograhic apparatus. The dot line area 1—1 shown in the drawing indicates a process control section. FIG. 7 is an enlarged view of the process control section. An image forming process will be described below with reference to these drawings.

The present electrophotographic apparatus has four image forming sections A to D that are similarly controlled to form toner images. Accordingly, an operation of the image forming section A will be described as a typical example.

First, in the drawing, reference numeral 1*a* denotes a photosensitive drum. Reference numeral 121A denotes a primary charger that emits corona charges to the photosensitive drum 1*a*. Reference numeral 122A denotes a primary grid attached to the primary charger 121A to adjust the corona charges to control the surface potential of the photosensitive drum 1*a* to a predetermined value. Reference numeral 123A denotes a developing unit that develops an electrostatic latent image formed on the photosensitive drum 1*a* to form a toner image (the electrostatic latent image is formed by applying a laser beam to the photosensitive drum 1*a* uniformly charged by the control provided by the grid). Reference numeral 3*a* denotes a transferring blade that transfers the toner image formed on the photosensitive drum 1*a* to a transferring sheet conveyed while being attracted to the transferring belt 2. Reference numeral 125A denotes a cleaner blade that scrapes off toner remaining on the photosensitive drum 1*a*. Reference numeral 126A denotes a pre-exposure lamp that eliminates charges remaining on the photosensitive drum 1*a*. Reference numeral 127A denotes a primary auxiliary charger that uniformly charges the photosensitive drum before primary charging.

In the above described configuration, a high-voltage current of minus several kV is applied to the primary charger 121A, thereby causing corona charges to be emitted to the photosensitive drum 1*a*. Some of the emitted corona charges are absorbed by the primary grid 122A, while the others are not absorbed but reach the photosensitive drum 1*a*. Consequently, the amount of charge supplied to the photosensitive drum 1*a* is uniformly adjusted by operation of the grid 122A. Subsequently, the photosensitive drum 1*a* is irradiated with a laser beam according to information on an image to be drawn to form an electrostatic latent image. Toner is then moved by an electric field caused by a difference between a bias voltage (typically minus several hundred V) supplied to developing sleeves in the developing unit 123A and the potential of the electrostatic latent image formed. Accordingly, a toner image is formed on the photosensitive drum 1*a* according to the electrostatic latent image. The toner image thus formed is transferred to the transferring sheet, conveyed while being attracted to the transferring belt 2, by a high-voltage current of plus several kV and several tens of $\mu$A supplied to the transferring blade 3*a*. Furthermore, the cleaner blade 125A scrapes residual toner off the photosensitive drum 1*a*, and the exposure lamp 126A deletes the charges. Then, for the next image formation, the photosensitive drum 1*a* is evenly charged by a high-voltage current of minus several kV and several hundred $\mu$V applied to the primary auxiliary charger 127A.

The above image forming process is executed by the image forming sections A to D to transfer four toner images to one transferring sheet so that the images are superimposed on one another.

Now, another process operation in the drawing will be described. In FIG. 7, reference numeral 128 denotes a separation charger that separates a transferring sheet conveyed while being attracted to the transferring belt, from the transferring belt 2. Reference numeral 129 denotes a pre-fixation charger that charges the separated transferring sheet. Reference numeral 130 denotes a roller that uniformly charges the transferring belt 2 and facilitates the sticking of the transferring sheet to the transferring belt 2. Reference numeral 131 denotes a roller acting as an opposite electrode for the roller 130. The rollers 130 and 131 correspond to the brush 6 in FIG. 4.

In the above described configuration, a transferring sheet with a toner image formed thereon is irradiated with coronas from the separation charger 128, in which an alternating-current high voltage of approximately 10 kVpp is superimposed on a direct-current high voltage of minus several kV and several hundred $\mu$A. The transferring sheet is thus separated from the transferring belt. Furthermore, to prevent the toner image from being destroyed by mechanical impact after the separation, the transferring sheet is charged by coronas applied by the pre-fixation charger 129, to which a high voltage of minus several kV has been supplied. The transferring sheet then passes through the fixer (not shown) to fix the toner image to the transferring sheet. The transferring sheet is then discharged.

On the other hand, the transferring belt 2, from which the transferring sheet has been separated, is uniformly charged by the roller 130, to which a high voltage of minus several kV is supplied and the roller 131, which acts as an opposite electrode. The transferring belt 2 thus attracts another transferring sheet.

Then, specific description will be given of Embodiment 1, that is, an example in which the present invention is implemented for high-voltage power supplies used for the above electrophotographic process.

Figure 1:
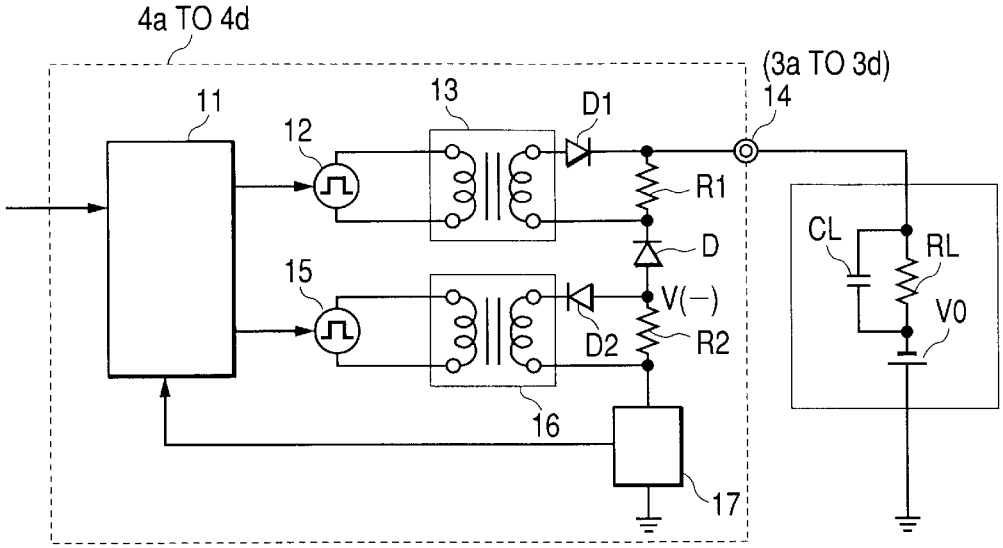
FIG. 1 is a block diagram showing a configuration of Embodiment 1.
Figure 4:
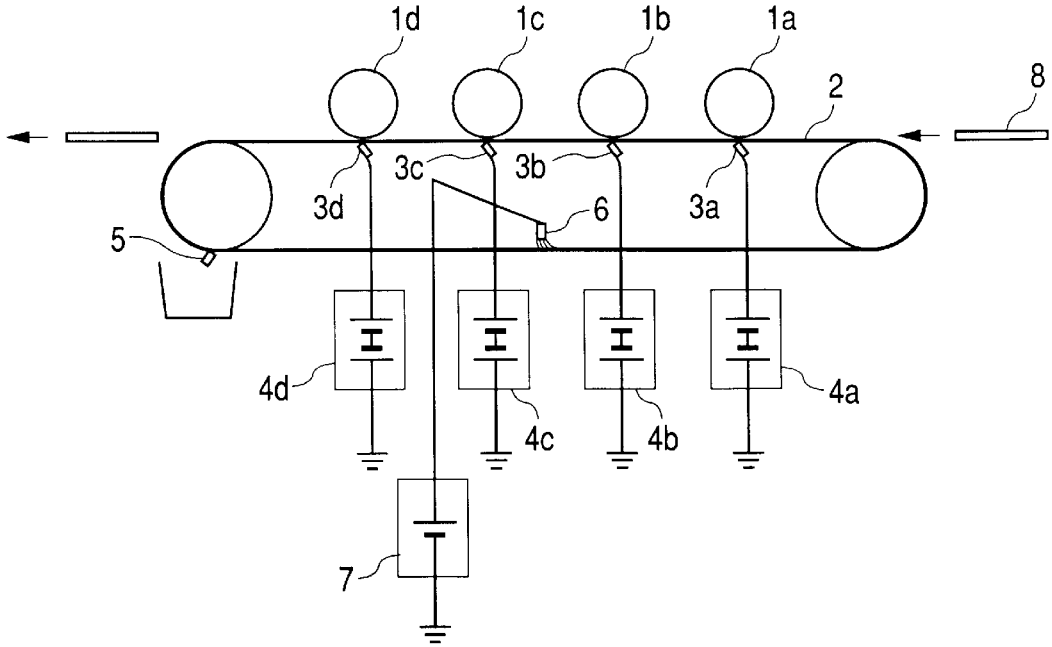
FIG. 4 is a block diagram of a circuit for an electrophotographic apparatus.
Figure 5:
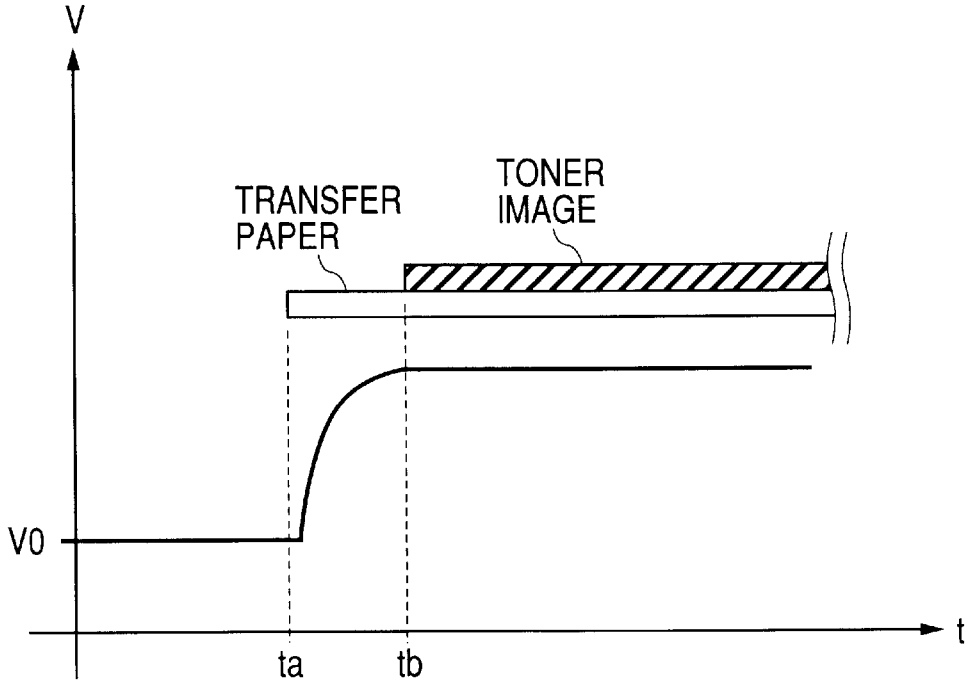
FIG. 5 is a timing chart illustrating a transferring operation performed by the electrophotographic apparatus.

FIG. 1 is a block diagram of a circuit in Embodiment 1, that is, an example in which the present invention is implemented for the transferring high-voltage power supplies 4*a* to 4*d*. The environment in which an apparatus of this embodiment is operated is similar to that in FIG. 4. FIG. 4 and description thereof are also used to describe this embodiment. That is, the transferring blades 3*a* to 3*d* have the transferring high-voltage power supplies 4*a* to 4*d*, shown in FIG. 4, connected thereto.

In FIG. 1, reference numeral 11 denotes a control unit that controls the transferring high-voltage power supplies 4*a* to 4*d* according to a control signal transmitted by a controller of the electrophotographic apparatus using a predetermined timing to cause desired outputs to be generated. Reference numeral 12 denotes a first drive unit that outputs a power signal according to a control signal from the control unit 11. Reference numeral 13 denotes a first transforming unit composed of a high-voltage transformer or the like that outputs a voltage-amplified alternating-current signal in response to the power signal from the first driving unit 12. Reference character D1 denotes a diode connected to the first transforming unit to rectify the voltage-amplified alternating-current signal to generate a plus direct-current signal. Reference character R1 denotes a bleeder resistor that discharges the generated direct-current voltage when the driving by the first driving unit 12 is stopped or braked. Reference numeral 14 denotes an output end that connects a generated high voltage output to a load. Reference numeral 15 denotes a second driving unit that outputs a power signal according to a control signal from the control unit 11 similarly to the first driving unit 12. Reference numeral 16 denotes a second transforming unit composed of a high-voltage transformer or the like that outputs a voltage-amplified alternating-current signal in response to the power signal from the second driving unit 15. Reference character D2 denotes a diode connected to the second transforming unit to rectify the voltage-amplified alternating-current signal to generate a minus direct-current signal. Reference character R2 denotes a bleeder resistor that discharges the generated direct-current voltage when the driving by the first driving unit 12 is stopped or braked. Reference numeral 17 denotes a current detecting unit that detects a load current corresponding to the high-voltage output from the output end to transmit a detection signal to the control unit 11. Reference character D denotes a diode characteristic of this embodiment. Further, a circuit connected to the output end and composed of a resistor RL, a capacitor CL, and a voltage source V0 simulatively represents transferring loads including the photosensitive drum 1, the transferring belt 2, and the transferring blade 3. The output ends 14 correspond to the transferring blades 3*a* to 3*d*.

In the above described configuration, first, when the transferring sheet 8 has not reached the transferring blade, the apparatus transmits a signal to the control unit 11 so as to generate a minus output. Upon receiving this signal, the control unit 11 transmits a signal to the driving unit 15. Upon receiving this signal, the driving unit 15 transmits a power signal to the second transforming unit 16. On the basis of this power signal, the second transforming unit 16 outputs a high-voltage alternating-current signal. The diode D2 rectifies this alternating-current signal to generate a minus high voltage. At this time, a voltage V(−) is generated. This voltage is set by the power signal from the second driving unit 15 so as to have a larger value than the voltage V0 which is present in the transferring load. Accordingly, in this state, a load current attempts to flow from the voltage V0 in the transferring load to the minus voltage V(−) via the output end 14. However, this flow is disabled by the diode D, and the current does not actually flow.

Now, description will be given of an operation performed after the transferring sheet 8 has reached the transferring blade 3.

Once the transferring sheet 8 reaches the transferring blade 3, the transferring high-voltage power supply 4 is controlled to provide a plus output so as to transfer a toner image on the photosensitive drum 1 to the transferring sheet 8. This control is carried out on the basis of a control signal from the apparatus. First, a signal is transmitted to the control unit 11 in order to stop the previously described minus output. Upon receiving this signal, the control unit 11 stops driving by the second driving unit 15. Thus, the high-voltage signal is stopped, and the minus voltage V(−) is discharged via the bleeder resistor R2. Subsequently, a signal from the apparatus is transmitted to the control unit 11 in order to generate a desired plus output. Upon receiving this signal, the control unit 11 transmits an operation signal to the first driving unit 12. Upon receiving this operation signal, the first driving unit 12 performs a predetermined operation to transmit a power signal to the first transforming unit 13. The diode D1 then rectifies an alternating-current high-voltage signal having its voltage amplified by the first transforming unit 13. Thus, a plus voltage is generated at the output end 4. At this time, a load current flows from the transferring blade 3 toward the transferring belt 2; it flows through the load to follow a path from the current detecting unit 17 through the resistor R2 to the diode D. A detection signal from the current detecting unit 17 is input to the control unit 11. The control unit 11 compares this detection signal with a control signal from the apparatus to transmit a signal that determines the operation of the first driving unit 12.

With the above operation, after the transferring sheet 8 has reached the transferring blade 3, the high-voltage apparatus is controlled so that a transferring current flows on the basis of the control signal from the apparatus.

When the transferring sheet 8 passes through the transferring blade 3, the apparatus transmits a signal to the control unit 11 in order to stop the transferring output. Thus, the power signal from the first driving unit 12 is stopped. The plus output is emitted through the bleeder resistor R1 and the transferring load.

As described above, the configuration of this embodiment includes the plus high-voltage power supply which generates a transferring current, and the minus power supply which disables generation of a plus-direction current because of the transferring load being negatively charged where the transferring sheet 8 is absent, as well as the diode D, provided between these high-voltage power supplies to block a current flowing in the minus direction. Accordingly, a 0 $\mu$A output can be realized regardless of the accuracy of the output from the power supply. This prevents image stains caused by a current flowing where the transferring sheet 8 is absent.

Further, this embodiment has been described in conjunction with the example in which the diode D is provided between the plus high-voltage power supply and the minus high-voltage power supply. However, the position where the diode D is connected is not limited to this aspect, but any connection position may be used provided that the passage of a minus-direction current is disabled. Accordingly, the diode D may be connected between the output end 14 and the transferring load in the direction in which the flow of the minus-direction current is disabled.

(Embodiment 2)

Figure 2:
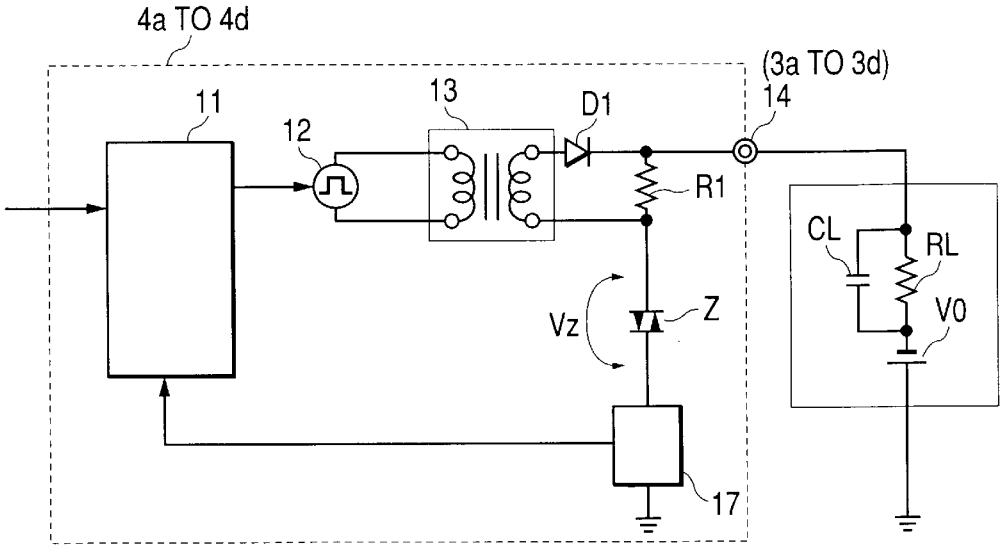
FIG. 2 is a block diagram showing a configuration of Embodiment 2.

FIG. 2 is a block diagram showing the transferring high-voltage power supplies 4*a* to 4*d* as Embodiment 2.

In the drawing, reference character Z denotes a varistor as a constant voltage element. A varistor voltage Vz is set to be larger than the charging voltage V0 of the transferring load. In the drawing, first, when the transferring sheet 8 has not reached the transferring blade 3, the apparatus transmits a control signal to the control unit 11 in order to stop driving by the first driving unit 12. In this state, if the transferring load is negatively charged, no current is generated unless this minus voltage V0 exceeds the varistor voltage Vz. Consequently, no currents flow in the plus direction. Furthermore, this embodiment does not have a minus power supply such as the one shown in Embodiment 1. As a result, no currents flow in the minus direction.

Then, once the transferring sheet 8 reaches the transferring blade 3, the same operation as that described in Embodiment 1 is performed to drive the plus high-voltage power supplies (12, 13, D1, R1) to transfer a toner image. Subsequently, when the transferring sheet 8 passes through, driving of the plus high-voltage power supply is stopped to allow plus charges to be emitted through the bleeder R1 and transferring load.

As described above, in this embodiment, the minus power supply and the diode D for disabling a minus-direction current in Embodiment 1 are omitted. Instead, the varistor having the varistor voltage Vz larger than the minus charging voltage V0 of the transferring load is provided to prevent a plus-direction current from being generated where the transferring sheet 8 is absent. This in turn prevents image stains.

This embodiment has been described in conjunction with the example in which the varistor is used as a constant voltage element. However, the present invention is not limited to this aspect, but for example, a Zener diode may be used provided that it provides a constant voltage higher than the minus charging voltage V0 of the transferring load.

(Embodiment 3)

Figure 3:
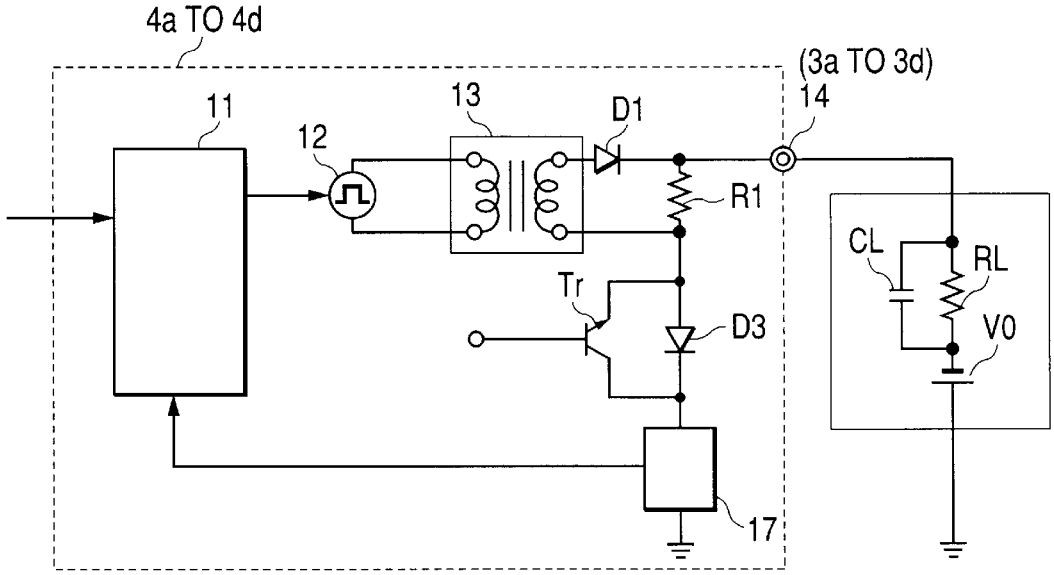
FIG. 3 is a block diagram showing a configuration of Embodiment 3.

FIG. 3 is a block diagram showing a configuration of the transferring high-voltage power supplies 4*a* to 4*d* as Embodiment 3.

In the drawing, reference character D3 denotes a diode that causes a current to flow in the minus direction. Reference character Tr denotes a transistor as a switch element used to switch the flow of a current from minus direction to plus direction.

With the illustrated configuration, when the transferring sheet 8 has not reached the transferring blade 3, the transistor Tr is controlled to remain off to prevent a plus-direction current from being generated by the minus charging voltage V0 of the transferring load. On the other hand, when the transferring sheet 8 reaches the transferring blade 3 and a toner image on the photosensitive drum 1 is to be transferred to the transferring sheet 8, the transistor Tr is turned on. Further, the plus high-voltage power supply composed of elements 12, 13, D1, and R1 is operated to supply a desired plus-direction current, thereby performing a predetermined transferring operation. The diode D3 is provided for protection so as to prevent a minus-direction current from destroying the transistor Tr. Further, the operation of the transistor Tr may be performed by the apparatus itself or by the control unit 11 synchronously with an output operation.

As described above, according to this embodiment, the "enabling" and "disabling" of the plus-direction current is switched by the control provided by the switch element. This prevents a plus-direction current from being generated where the transferring sheet 8 is absent, thereby preventing image stains.

This embodiment has been described in conjunction with the example in which the transistor is used as a switch element. However, the present invention is not limited to this aspect, but a FET, a relay, or the like may be used. Further, the transistor is not limited to the illustrated NPN type but may be, for example, a PNP, N, or P type.

Embodiments 1 to 3 have been described in conjunction with the example in which the plus output is used as a transferring current and in which the plus-direction current is prevented from flowing at unwanted timing. However, the present invention is not limited to this aspect; a minus output may be used as a transferring current and the minus-direction current may be prevented from flowing at unwanted timing.

Furthermore, Embodiments 1 to 3 have been described in conjunction with the example in which a toner image is transferred from the photosensitive drum to the transferring sheet. However, the present invention is not limited to this aspect; for example, a toner image may be transferred from the photosensitive drum to the transferring belt or from the transferring belt to the transferring sheet.

Moreover, the above-described example relates to the transferring high-voltage power supply. However, the present invention is not limited to this aspect, but is applicable to any high-voltage power supply apparatus used in an electrophotographic apparatus where a plurality of process loads to which the high-voltage power is supplied and the arrangements of the apparatus cause generation of an unwanted current in any of the plurality of the process loads in the supply direction of the high-voltage power. The present invention includes all such cases.

The above embodiments show an example of an image forming apparatus having a transferring device that transfers a developed image resting on an image carrier, to a medium, a high-voltage power supply that applies a high voltage to the transferring device, and a disabling device that disables the flow of a current through the transferring device while the high-voltage power supply is not applying a high voltage to the transferring device.

The disabling device disables generation of a current caused by charges. The image carrier is a photosensitive body. Alternatively, the image carrier may be an intermediate transferring body. The medium is a recording sheet. Alternatively, the medium may be an intermediate transferring body. The intermediate transferring body is an intermediate image carrier that receives an image developed on the photosensitive body and transfers this image on the recording sheet.

The apparatus has a chargeable charging member arranged in contact with the transferring device. The disabling device disables generation of a current caused by the charges possessed by the charging member.

The disabling device includes a second high-voltage power supply that applies a high voltage with a polarity opposite to that of the above high-voltage power supply and a rectifying element connected in series with the second high-voltage power supply.

The disabling device includes a varistor.

The disabling device includes a rectifying element and a transistor connected in parallel with the rectifying element and oriented in the direction opposite to that of the rectifying element.

Further, the above described embodiments show an example of an image forming apparatus having a first high-voltage power supply that applies a high voltage to a load, a second high-voltage power supply that applies, to the load, a high voltage with a polarity opposite to that of the first high-voltage power supply, and a current disabling device that disables the flow of a current generated by the second high-voltage power supply.

The current disabling device is a rectifying element.

While the first high-voltage power supply is applying a voltage to the load, the second high-voltage power supply does not apply any voltage. While the second high-voltage power supply is applying a voltage to the load, the first high-voltage power supply does not apply any voltage.

The first high-voltage power supply and the second high-voltage power supply are connected in series with each other.

The load is a transferring device that transfers a developed image resting on an image carrier, to a medium.

As described above, while power is being supplied to a predetermined load associated with an electrophotographic process, the flow of a current can be disabled which is generated in the above power supplying direction owing to charging of the load itself or the like.

More specifically, the effects described below are produced.

The use of the present invention for a transferring high-voltage power supply prevents the flow of an unwanted current at points of time other than desired ones. This prevents the drum from being charged because of unwanted current, thereby preventing resultant image stains or the like.

The use of the present invention for a developing bias high-voltage power supply apparatus prevents toner from being developed at points of time other than the desired ones owing to generation of an unexpected charging potential on the photosensitive drum, thereby preventing carriers from sticking to the photosensitive drum. This avoids a waste of toner, staining of the apparatus, and a decrease in the lifetime of the apparatus.

If the present invention is used for a high-voltage power supply apparatus for an operation around the transferring belt such as separation, and the transferring belt is composed of a material with a relatively small resistance value, then an operating current from the adjacent high-voltage power supply apparatus is prevented from being bypassed. This avoids degrading the charging effect, the static-electricity elimination effect, or the like.

If the present invention is used for a primary high-voltage power supply apparatus, a primary auxiliary high-voltage power supply apparatus, a pre-fixation high-voltage power supply apparatus, or a separating high-voltage power supply apparatus, then coronas from the adjacent high-voltage power supply apparatus are prevented from being bypassed. This avoids degrading the charging effect, the static-electricity elimination effect, or the like.

In addition, if a plurality of high-voltage power supply apparatuses are used according to a process configuration for a copier, an operating current from each of the high-voltage power supply apparatuses is prevented from being bypassed by another high-voltage power supply apparatus. Therefore, each high-voltage power supply apparatus can effectively produce a charging effect or a static-electricity elimination effect.

What is claimed is:

1. An image forming apparatus comprising:

a transferring device that transfers a developed image resting on an image carrier, to a medium;

a first high-voltage power supply that applies a high voltage having a first polarity to said transferring device when the developed image resting on the image carrier is transferred to the medium;

a second high-voltage power supply that applies a high voltage having a second polarity opposite to the first polarity to said transferring device when the developed image resting on the image carrier is not transferred; and a rectifying element that disables flow of a current to be caused by said second high-voltage power supply from the image carrier to said transferring device.

2. The image forming apparatus according to claim 1, wherein said rectifying element disables generation of a current caused by charges.

3. The image forming apparatus according to claim 1, wherein the image carrier is a photosensitive body.

4. The image forming apparatus according to claim 3, wherein the medium is a recording sheet.

5. The image forming apparatus according to claim 1, wherein the medium is a recording sheet.

6. The image forming apparatus according to claim 1, further comprising a chargeable member arranged in contact with said transferring device, wherein said rectifying element disables generation of a current caused by charges on said chargeable member.

7. The image forming apparatus according to claim 6, wherein said chargeable member is a transporting belt that transports the medium to said transferring device.

8. The image forming apparatus according to claim 7, wherein said first high-voltage power supply does not apply the high voltage when the medium does not exist at said transferring device, and applies the high voltage when the medium exists at said transferring device.

9. The image forming apparatus according to claim 1, wherein said rectifying element is connected in series with said second high-voltage power supply.

10. An image forming apparatus comprising:

a transferring device that transfers a developed image resting on an image carrier, to a medium;

a high-voltage power supply that applies a high voltage to said transferring device; and a varistor connected in series with said high-voltage power supply, which disables flow of a current through the image carrier, said transferring device, and said high-voltage power supply, while said high-voltage power supply is not applying any high voltage to said transferring device.

11. An image forming apparatus comprising:

a transferring device that transfers a developed image resting on an image carrier, to a medium;

a high-voltage power supply that applies a high voltage to said transferring device; and a transistor connected in series with said high-voltage power supply, which disables flow of a current through said image carrier, said transferring device, and said high-voltage power supply, while said high-voltage power supply is not applying any high voltage to said transferring device.

12. An image forming apparatus comprising:

a first high-voltage power supply that applies a first high voltage having a first polarity to a load;

a second high-voltage power supply that applies, to the load, a second high voltage having a second polarity opposite to the first polarity; and a rectifying element that disables flow of a current to be caused by said second high-voltage power supply from the load to said second high-voltage power supply, while said second high-voltage power supply is applying the second high voltage.

13. The image forming apparatus according to claim 12, wherein while said first high-voltage power supply is applying the first high voltage to the load, said second high-voltage power supply does not apply any voltage, and while said second high-voltage power supply is applying the second high voltage to the load, said first high-voltage power supply does not apply any voltage.

14. The image forming apparatus according to claim 12, wherein said first high-voltage power supply and said second high-voltage power supply are connected in series with each other.

15. The image forming apparatus according to claim 12, wherein the load is a transferring device that transfers a developed image resting on an image carrier, to a medium.

16. An image forming apparatus comprising:

a transferring device that transfers a developed image resting on an image carrier, to a recording sheet;

a first high-voltage power supply that applies a high voltage having a first polarity to said transferring device when the developed image resting on the image carrier is transferred to the recording sheet;

a second high-voltage power supply that applies a high voltage having a second polarity opposite to the first polarity to said transferring device when the developed image resting on the image carrier is not transferred; and a rectifying element that disables flow of a current to be caused by said second high-voltage power supply from the image carrier to said transferring device.

* * * * *

UNITED STATES PATENT AND TRADEMARK OFFICE

CERTIFICATE OF CORRECTION

PATENT NO. : 6,731,892 B2
DATED : May 4, 2004
INVENTOR(S) : Koji Doi

It is certified that error appears in the above-identified patent and that said Letters Patent is hereby corrected as shown below:

Title page,
Item [56], References Cited, FOREIGN PATENT DOCUMENTS,
"JP 2000284617 A * 10/2000 …… G03G/15/16" should read
-- JP 2000-284617 A * 10/2000 …… G03G/15/16 --.

Column 2,
Line 36, "sheets 8" should read -- sheet 8 --.

Signed and Sealed this

Ninth Day of November, 2004

JON W. DUDAS
*Director of the United States Patent and Trademark Office*